United States Patent [19]

Walsh

[11] Patent Number: 5,033,348

[45] Date of Patent: Jul. 23, 1991

[54] BOX CUTTING MACHINE

[75] Inventor: James F. Walsh, Shrewsbury, Mass.

[73] Assignee: J&M Engineering Corporation, Shrewsbury, Mass.

[21] Appl. No.: 267,343

[22] Filed: Nov. 4, 1988

[51] Int. Cl.[5] ..... B67B 7/38

[52] U.S. Cl. ..... 83/622; 83/555; 83/614; 30/2; 493/56

[58] Field of Search ..... 83/368, 926 K, 39, 622, 83/614, 555, 549; 30/2; 493/56

[56] References Cited

U.S. PATENT DOCUMENTS

| | | | |
|---|---|---|---|
| 3,227,016 | 1/1966 | Moeller | 83/455 |
| 3,606,058 | 9/1971 | Davis | 30/2 |
| 3,763,557 | 10/1973 | Sewell | 83/368 |
| 4,505,174 | 3/1985 | Carithers | 83/555 |
| 4,641,556 | 2/1987 | Vigneron et al. | 83/39 |

FOREIGN PATENT DOCUMENTS

| | | | |
|---|---|---|---|
| 460917 | 6/1928 | Fed. Rep. of Germany | 30/2 |

*Primary Examiner*—Douglas D. Watts
*Assistant Examiner*—Scott A. Smith
*Attorney, Agent, or Firm*—Norman S. Blodgett; Gerry A. Blodgett

[57] ABSTRACT

Box cutting machine having driven knives that cut a line along a selected level on two intersecting side walls of a box.

14 Claims, 1 Drawing Sheet

BOX CUTTING MACHINE

This invention relates to a box cutting machine and more particularly to a power operated cutter for opening corrugated paper boxes at supermarket locations and the like.

BACKGROUND

The following is a list of the best art known to the inventor at the time of the filing of this application:

2,729,885 to Wahl et al Jan. 10, 1956
3,135,048 to Daugherty et al June 2, 1964
3,137,068 to Quigley June 16, 1964
3,175,288 to Garwick et al Mar. 30, 1965
3,224,089 to Gibbons Dec. 21, 1965
3,457,642 to Steer et al July 29, 1969
3,606,058 to Davis Sept. 20, 1971

The patents to Wahl et al and Quigley both show simple spring loaded knife means mounted on the opposite sides of a conveyor means to slit the oppositely disposed parrallel walls of a carton or the like moving along the conveyor. The box is turned at 90° while still on the conveyor and is between the knife stations, to complete the cutting of the remaining two sides of the carton.

Daugherty et al, Garwick et al and Gibbons each show a device adapted to cut only one side of a carton or box disposed at the work station. In using this kind of a set up, it is necessary to rotate the carton three times after cutting the first side of the box to complete the opening operation.

The Steer et al and Davis patents disclose conveyor arrangements disposed at right angles to each other for conveying a box or carton to be opened past cutting knives that are pressed against the opposite parrallel sides of the boxes.

BRIEF DESCRIPTION OF THE INVENTION

Shown here is a machine having a table that forms a working station to hold a rectangularly shaped corrugated paper shipping box that must be opened to expose the several individual retail sized cans, cartons, or other types of rigid items normally shipped in corrugated boxes. The table is adapted to be driven to be raised or lowered to accurately position the corrugated box relative to power driven cutting means whereby such means may be operated to slit two sides of the box that are disposed perpendicularly one with respect to the other and then after the first two sides have been cut, the box is rotated 180° on the table and again the cutting means are driven to slit the remaining two perpendicularly disposed sides of the shipping box so that one severed section of the box may be separated from the other section thereof by the slitting operation and can be removed to expose the individual cartons, cans, or the like supported upon the other severed section of the corrugated paper carton.

In another form of the machine the power driven cutting means could be raised or lowered adjacent to the work station on a fixed table means, which table could be integrated into a conveyor system for example.

Suitable power means and control circuitry is built into the machine to control the semi-automatic operation of the slitting procedure. The control preferably includes manual means to energize the means for adjusting the relative positions of the knives and the table support for the box being cut. A foot operated switch can be provided to initiate the cutting action that is preferably coordinated with manual switch means for insuring the safe operation of the machine by keeping the hands of the operator in a safe position at all times when the knife means is being power driven.

IN THE DRAWINGS

DETAILED DESCRIPTION

Figure 2:
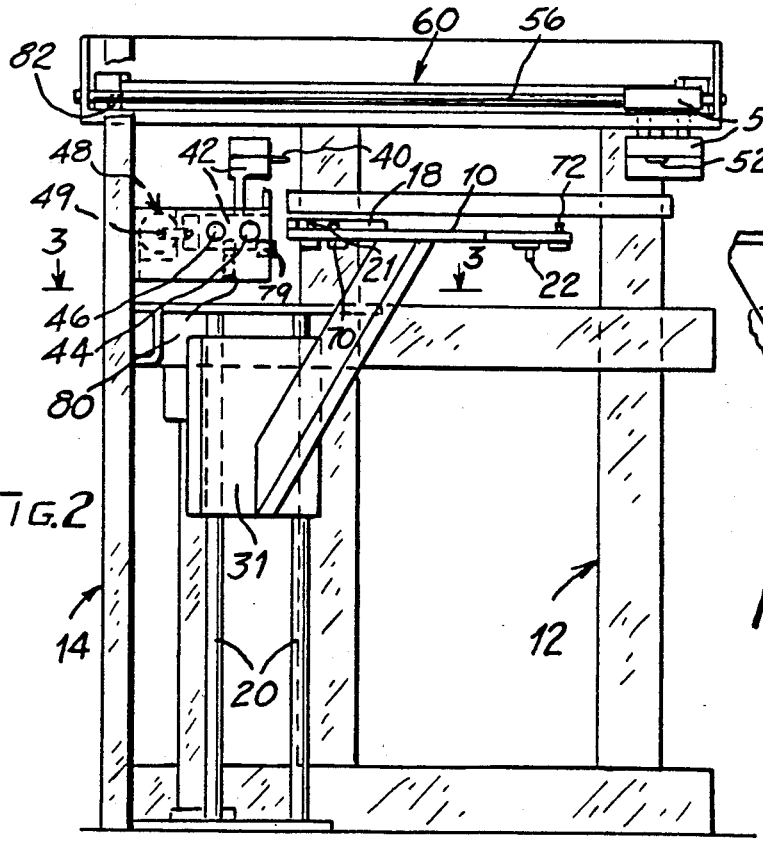
FIG. 2 is a side elevation of the machine shown in FIG. 1.
Figure 4:
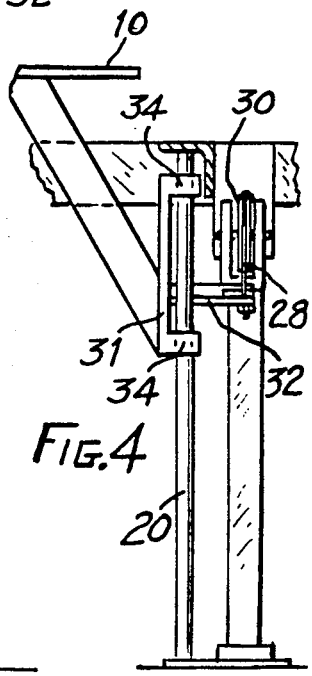
FIG. 4 is a view taken on line 4—4 of FIG. 3.

In one form of the invention, the table 10 that forms the work station, is adjustably positioned at a convenient height to receive a corrugated paper box to be cut open, the table being located within the confines of the left and right hand knife carrying means and the individual knives being slidably supported on slide means carried in the supporting frames generally indicated by the arrows 12 and 14 respectively. The table is adapted to have a rectangularly shaped corrugated paper box manually or otherwise placed thereon with one corner of the box nestled in the holding walls 16 and 18 on the left and right hand sides of the table on the inside corner thereof at the location where the paths of the driven cutting means intersect as will appear below. In the machine shown in FIG. 2, the table that has been raised to its highest level, is carried on a cantilever mounting means that is slideably supported on the vertical post means 20, as best seen in FIGS. 2 and 4.

An indicator switch 21 located within the confines of the holding walls 16 and 18 on the table is provided to indicate when a box is in position to be worked upon. When this switch has been activated by the inward movement of a box into position on the table, the table is adjusted downwardly vertically from the position shown in FIG. 2, by manipulating the joy stick 22 located under the front edge of the table 10 that is placed there in a position to be easily reached by the operator. When for example the machine is pneumatically powered, the joy stick controls the flow of compressed air to drive a piston in a cylinder (which pneumatic means are not shown). The piston is connected at its driving end to a cable 28 that is trained over a pulley 30, the other end of the cable being connected to a horizontally extending lug 32 that is integral with a support means 31 for table 10. The support means 31 has integral bearing means 34 that is slideably mounted on vertically disposed bearing rod means 20 so that the as the piston is driven in its cylinder the table is raised or lowered accordingly, under the control of the joy stick whereby to position the sides of the box to be cut in a proper position to be severed as the knives are driven to engage the sides and to be moved along the exposed sides of the box on the table. An electrically powered drive means of course would be entirely practical for use in this machine.

Figure 1:
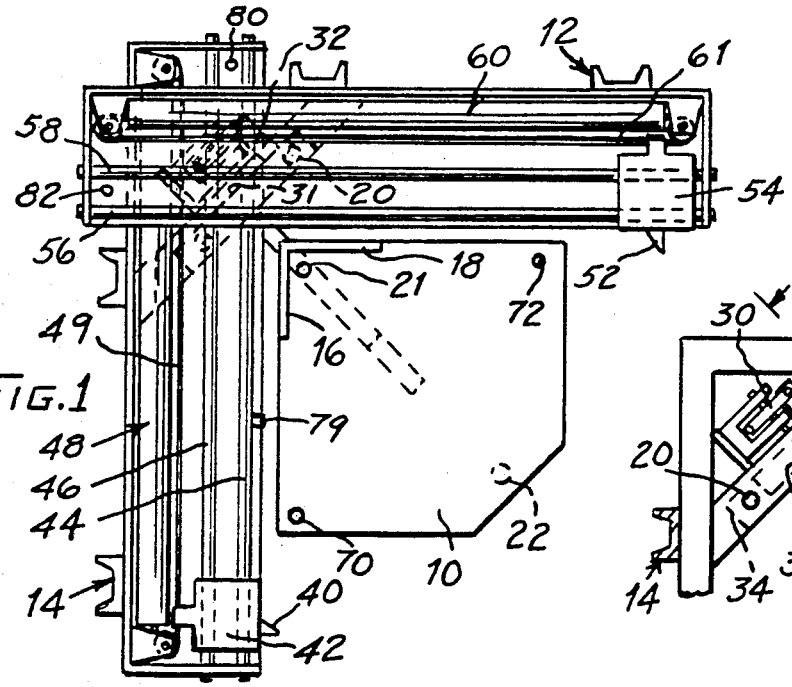
FIG. 1 is a plan view showing the machine of this invention.
Figure 3:
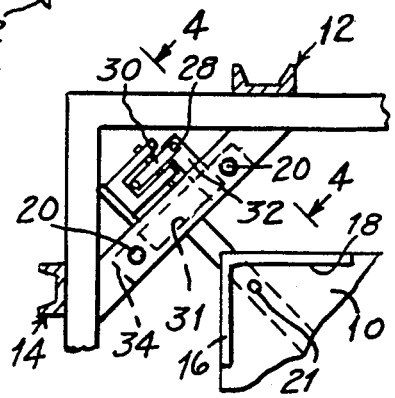
FIG. 3 is a view taken on line 3—3 of FIG. 2 with the table that is positioned over the plane of 3—3 shown, in dotted lines.

Suitable pneumatically powered or electric motor driven knife carrying means are mounted within the supporting frames 12 and 14, the knives being carried on slide means adapted to move along the full length of the two sides of the box. As shown in FIG. 1 a knife blade 40 is mounted on a left hand slide means 42 that slides on the horizontally disposed bearing rods 44 and 46 to pass along the entire length of one side of the table. The sliding head 42 is connected to and driven by a pneumaticly powered cable means or by an electric motor and cable drive means collectively designated generally as 48 that drives cable 49 as shown in FIG. 1, to reciprocate the knife head along the entire length of one side of the box with the knife blade 40 projecting over the table to just slice through the corrugated paper side of the exposed left side of the box.

A similarly mounted knife 52 is provided on the right hand side of the box, carried on a sliding head 54 supported on bearing rods 56 and 58, that is driven by a similarly powered drive means 60 to drive cable 61 on the right hand side to cut along the full length of the right side of the box on the table.

The bearing rods 44 and 46 are disposed at a right angle with respect to bearing rods 56 and 58. By positioning the sliding supports for the cutting means perpendicular one with respect to the other at a stationary work station, the requirement for making a size adjustment for the length and width of any carton on the table is eliminated and only the vertical height of the cut must be set for the variously sized cartons to be cut.

The knives 40 and 52 both move in the same plane so the cuts made along each one of the two perpendicularly disposed sides of the box, intersect at the inner corner of the box on the table and, therefore, the drive of the respective knife heads must be energized in a cycle such that the left hand knife 42 must complete its cutting action and move to the inner end of its slide motion along bearing means 44 and 46 and return past the point of intersection before knife 52 on its mounting head 54 reaches the inner end of its motion along bearings 56 and 58. It should be noted, that the knife mounting means 40 and 52 must each be moved past the inwardly disposed end of the box on the table without interfering one with the other to carry knife means 40 and 52 completely beyond the left and right sides of the box on the table to cause the paths of the two cuts to intersect at the corner of the box. In order to speed up the cutting cycle, when knife 40 is first driven along the left side of the box, a switch means 79 may be located approximately half way along the path of the slide 42 for the knife 40, that can be tripped to energize the drive for the cutting stroke of knife 52 that then follows knife 42 to the inside corner of the machine, the left slide and knife 40 having in the meantime started on their return trip to be moved away from the the inner corner of the machine to avoid crashing into slide 54.

The left cutting mechanism assembly and the right cutting mechanism assembly are identical with the exception of their respective orientation with respect to the table 10. The right hand knife assembly including bearing rods 56 and 58 and the pneumatic or other drive assembly 60 is positioned adjacent the corresponding left hand assembly. The knife supporting slide means 42 and 54, however are driven to move in the same plane and the respective movements of these sliding heads is coordinated so that they do not collide.

After the first cycle has been completed, the knives are both returned to their starting positions and the box is turned 180° around on the table and the remaining uncut sides are cut to completely separate the top from the bottom section of the carton. Thus after the first cutting cycle has been completed and the knife means have been duly positioned in their starting positions as illustrated in FIG. 1, the second cycling of the knife means is performed to cut the remaining sides of the box.

First, however, it should be stated that in the prefered form of the machine the box positioning and cutting cycle is performed under the control of the operator who stands at the front end of the work station at the table i.e. at the outer end of the box. As mentioned above, the table is adjusted by means of the manipulation of the joy stick 22 to its desired height to position the box on the table in a desired position relative to knife means 40 and 52 while the knives are in the positions illustrated in FIG. 1. When the box has been placed on the table and adjusted to be in the proper position to be worked upon with the inner end of the box pushed into intimate contact with walls 16 and 18, the indicator switch 21 is tripped at the front end of the box to show that the box is properly located in a position to have two of its adjacent sides cut. To initiate the cutting operation, it is necessary for safety reasons, for the operator to manually press and hold a left hand switch 70 conveniently mounted on the table or frame 48 with one hand and to press and hold a right hand switch 72 similarly mounted on the right hand side of the table. The switches 70 and 72 are interconnected to make it impossible to operate the power driven cutting means unless both hands are positively removed from the respective paths of the knife means.

In the prefered operation of the machine, the first cutting action is initiated when locator switch 21 at the front end of the box on the table and both of the switches 70 and 72 are manually operated and are held closed so that the pneumatic cylinder or electrically powered drive means 48 is energized to drive knife means 42 horizontally along the left side of the box on the table while the two manually held switches remain closed and until knife mounting head 42 trips a switch 80 at the end of its cutting stroke that initiates a return of slide 42 to its starting position. When switch 79 at the half way point of the stroke of slide 42 is activated, the power means 60 for drawing the right hand knife 52 is energized, assuming of course that the hand held switches 70 and 72 are still held closed and the other, or right hand side of the box on the table is cut and when switch 82 is tripped by slide 54 at the inner end of its stroke, slide 54 is returned to its starting position. Upon completion of these two cutting strokes and after the knives 40 and 52 have been succesively returned to their starting positions, switches 70 and 72 can be released and the drive means for both of the knife means are deactivated.

It is apparent that electrically powered means may be used to raise and lower the table or knife means which ever one of these assemblies is made adjustable in the machine to adjust the knife cuts to the cartons being opened on the machine. As above indicated, either an electrical or pneumatic drive means may be used interchangably to operate any of the features of this machine.

The table can be mounted adjacent any convenient form of conveyor means and the table can be provided with roller bearing means on its surface to make the delivery of the cartons into the machine quite simple.

It is obvious of course that the interconnected switch means 70 and 72 may be omitted and the machine can be simply be put into automatic operation by suitable control circuitry (not shown) under the control of switch 21 for example. This might be the situation particularly if a suitable power driven conveyor system and infeed means for pushing a carton into position on table 10 were to be designed. It is suggested for example that a two station design might be coordinated with a power driven conveyor means together with a cooperating infeed system such that cartons to be emptied would not be turned on the table but could be fed succesively to adjacent stations for completion of the cutting operations. Such a completely automated system might be found useful in a canning factory for example where a large number of empty cans must be fed to filling and closing machinery for subsequent shipment to consumers.

While the above description covers the preferred form of this invention, it is possible that modifications thereof will occur to those skilled in the art that will fall within the scope of the following claims.

I claim:

1. A cutting machine for opening rectangularly shaped corrugated boxes having side walls that intersect along a line at each of the corners of the box, comprising a fixed work table means for holding a box to be cut open, a pair of power driven knife means cooperating with said table means to produce a clean cut on the same level through the pair of intersecting side walls of a box on said table, separate means to drive each one of said pair of separate knife means, and means to energize each of said separate knife drive means in stepped sequence along a stroke that includes, but is longer than the length of each of said side walls respectively, each of said strokes beginning at one end of one of said intersecting walls and extending past a common point located along one of said lines at one of the corners of said intersecting side walls of said box, means to position a corner of the box on the table at said common point, said drive means moving first one and then the other of said knife means along said stroke and past said common point whereby to cut toward the intersection through first one and then the other one of said intersecting walls.

2. A cutting machine as in claim 1 wherein said table and knife means have an adjusting means for cooperating therewith whereby the position of said table and knife means may be adjusted relative to each other.

3. A cutting machine as in claim 2 wherein each one of said pair of knife means reciprocates along a horizontal path and said adjusting means moves said table vertically.

4. A cutting machine as in claim 1 wherein said table supports a box being cut so that when two intersecting sides have been cut, the box may be turned 180° on said table to have its remaining two sides cut whereby to separate one section of said box from another section thereof.

5. A machine as in claim 1 wherein said machine includes control means that are activated by an operator when a box is in position on said table to be cut to cause said separate drive means to be energized.

6. A machine as in claim 5 wherein said control means includes means to produce said one cutting sequence and then said other cutting sequence.

7. A machine as in claim 5 wherein said means to drive said separate knife means are activated serially by said control means and a limit switch coacts with said control means.

8. A machine as in claim 7 wherein said control means includes a pair of manually operated switches that are adapted to be turned on and held open to energize the knife means, said manual switches being spaced apart so that one switch is operated by the right hand while the other switch is operated by the left hand.

9. A machine as in claim 1 wherein said means to drive said separate knife means are activated serially and each drive means has a limit switch at the end of each of their respective strokes whereby to coordinate the drive of the respective knife means in a properly timed sequence.

10. A machine for cutting a pair of intersecting side walls of a corrugated paper box comprising a table for supporting the carton to be cut, a pair of cutting means adjacent said table, each one of said pair of cutting means being adapted to be driven respectively along a path adjacent each of said intersecting sides of the carton supported on said table to be cut, a pair of support means for each of the respective cutting means, said support means being adapted to carry one of said cutting means in a path that is disposed at a right angle to the path of the other of said cutting means and through the intersection of the sides, means to position a corner of a box on the table to be cut at said point of intersection, and drive means to move first one and then the other of said pair of cutting means past said point of intersection.

11. A machine as in claim 10 wherein said machine includes adjusting means to position said cutting means relative to the box supported on said table.

12. A machine as in claim 10 wherein said machine includes control means that are activated when a box is in position on said table to be cut to permit said drive means to be energized.

13. A machine as in claim 10 wherein said means to drive said cutting means to produce said first cut and the other of said cuts includes an electric switch adjacent said point of intersection as well as a switch at the end of the path of the movement of each of the respective cutting means past the point of intersection whereby to assist in energizing the cutting means in a properly timed sequence.

14. Box cutting machine, comprising:

(a) a table having a flat upper horizontal surface with a guide having right angle walls for supporting and locating a box to be opened, a corner of the box being located in the guide, (b) a frame extending to a height substantially greater than the level of the said horizontal surface of the table, (c) two horizontal tracks mounted on the frame and extending at a right angle to each other and parallel to the walls of the guide, (d) a cutting blade support slidably mounted on each track and adapted to carry a knife blade extending inwardly of the table for contact with the box on a selected level for movement on intersecting paths, (e) means for adjusting the vertical distance between the said table surface and the knife blades, (f) and drive means for producing movement of the blades and supports along tracks in a cycle in which one blade procedes the other in passing through the corner of the box.

* * * * *